US011324344B2

(12) United States Patent
Davidson et al.

(10) Patent No.: US 11,324,344 B2
(45) Date of Patent: May 10, 2022

(54) SERVING DISH APPARATUS

(71) Applicant: BooginHead LLC, Issaquah, WA (US)

(72) Inventors: Sari Davidson, Issaquah, WA (US); Sean M. Barry, North Olmsted, OH (US); Timothy C. Hayes, Lakewood, OH (US)

(73) Assignee: BOOGINHEAD LLC, Issaquah, WA (US)

( * ) Notice: Subject to any disclaimer, the term of this patent is extended or adjusted under 35 U.S.C. 154(b) by 0 days.

(21) Appl. No.: 17/125,389

(22) Filed: Dec. 17, 2020

(65) Prior Publication Data

US 2021/0186239 A1 Jun. 24, 2021

Related U.S. Application Data

(60) Provisional application No. 62/949,988, filed on Dec. 18, 2019.

(51) Int. Cl.
*A47G 19/02* (2006.01)

(52) U.S. Cl.
CPC ..... *A47G 19/02* (2013.01)

(58) Field of Classification Search
CPC ..... A47G 19/02; A47G 19/04; A47G 23/06; A21B 3/13; A21B 3/131
USPC ..... 220/575, 23.83, 23.4, 23.88
See application file for complete search history.

(56) References Cited

U.S. PATENT DOCUMENTS

| | | | | |
|---|---|---|---|---|
| 748,099 | A | 12/1903 | Prikryl | |
| 1,290,186 | A | 1/1919 | Held | |
| 1,587,288 | A | 6/1926 | Dooly | |
| 2,207,520 | A * | 7/1940 | Rhody | B65D 77/08 206/229 |
| 2,522,397 | A | 9/1950 | Palmer | |
| D160,688 | S * | 10/1950 | Brock | D7/501 |
| 3,384,260 | A | 5/1968 | Buffington | |
| 3,677,168 | A | 7/1972 | Bell | |
| 4,925,047 | A * | 5/1990 | Valentine | A61B 50/10 206/570 |
| 5,074,777 | A | 12/1991 | Garner | |
| D341,539 | S * | 11/1993 | Davis | D7/550.1 |
| D364,537 | S | 11/1995 | Anderson | |
| D384,861 | S | 10/1997 | Richard | |
| 5,732,847 | A * | 3/1998 | Caldi | A47G 19/065 206/546 |
| 6,287,619 | B1 | 9/2001 | Khan | |
| 7,480,999 | B2 | 1/2009 | Atwater et al. | |
| D587,517 | S | 3/2009 | Cheng | |
| D676,340 | S | 2/2013 | Reefer | |
| 9,107,421 | B2 | 8/2015 | Campbell et al. | |
| D784,066 | S | 4/2017 | Keating | |
| D826,621 | S | 8/2018 | Mirchandani et al. | |
| D828,710 | S | 9/2018 | Mirchandani et al. | |
| D847,193 | S | 4/2019 | Laing et al. | |
| D877,096 | S | 3/2020 | Stiehl | |
| 2015/0069215 | A1 | 3/2015 | Kohnen | |
| 2015/0201802 | A1 | 7/2015 | Moore | |
| 2020/0163474 | A1 | 5/2020 | McCartney | |
| 2021/0169250 | A1 | 6/2021 | Czubak et al. | |
| 2021/0186239 | A1 | 6/2021 | Davidson et al. | |

* cited by examiner

*Primary Examiner* — Andrew D Perreault
(74) *Attorney, Agent, or Firm* — Adam L. K. Philipp; Martin Spencer Garthwaite; Aeon Law

(57) ABSTRACT

A serving dish apparatus comprising a plate and one or more removable nested serving sections.

3 Claims, 15 Drawing Sheets

SERVING DISH APPARATUS

CROSS-REFERENCE TO RELATED APPLICATIONS

The present application is a non-provisional of, claims the benefit of the filing date of, and incorporates by this reference the subject matter of U.S. provisional patent application Ser. No. 62/949,988, filed Dec. 18, 2019.

FIELD

The present disclosure relates to a serving dish apparatus, in particular, to a serving dish apparatus comprising a plate and removable nested serving section.

BACKGROUND

As used herein, a "serving dish" is a bowl, plate, or combination thereof used to serve liquid or solid food (collectively referred to as "food"), generally, though not exclusively, for consumption by one person. As used herein, "serving dish" does not include cutlery, such as knives, forks, and spoons, and drinkware, such as cups and glasses.

As used herein, a "plate" is a serving dish comprising a flat or gently curved section on or rising from a horizontal plane relative to a normal gravitational field and a rim, wherein the rim may project up from the horizontal plane, and where a height of the rim above the horizontal plane is less than half of a radius of the flat section.

As used herein, a "bowl" is a serving dish comprising a flat or curved section on or rising from a horizontal plane relative to a normal gravitational field and a rim, wherein the rim projects up from the horizontal plane, and where a height of the rim above the horizontal plane is equal to or greater than half of a radius of the flat section.

Human and other animal consumers (collectively referred to herein as, "consumers") of liquid and solid food (collectively referred to herein as, "food") often want to keep different types of food separate. The reasons for doing so include for visual aesthetics of the food, for visual aesthetics of the serving dishes, for reasons having to do with taste, for reasons having to do with preparation, handling, seasoning, and storage of the separate food items or cleanup. Handling separate food items separately may allow for efficiencies in preparation, presentation, consumption, and cleanup of the separate food items.

When a consumer is consuming more than one food item from a serving dish, a first food item may benefit from or need to be heated, reheated, or cooled separately from a second food item on or to be placed on the serving dish. A consumer of food or another party may desire that a food item on a serving dish be removed from the serving dish, including for storage, for heating or cooling, or the like. At a later time, the consumer or other party may desire to return the removed food item to the serving dish or to another serving dish, such as after the removed food item has been warmed up in a microwave or after the removed food item has been stored for a period of time.

Some consumers—such as adults, children, the elderly, those with a medical condition—may not be able to keep separate food items separate on a serving dish, notwithstanding a desire by such consumer or another party that separate food items be kept separate on the serving dish.

A serving dish with separate segments or sections built into the serving dish may not allow a food item to be removed and return to the serving dish, without soiling another dish, using a plastic bag or another container, or without other waste or inconvenience. A physical partition added to a serving dish after it is manufactured may not prevent a liquid from flowing beneath the physical partition.

A serving dish, such as a bento box, may comprise multiple partitions built into the serving dish, wherein one or more of the built-in partitions may loosely accommodate a smaller serving dish. However, build-in partitions cannot be reconfigured.

When a smaller serving dish(es) is placed on a larger serving dish, one or another of the serving dishes may be less stable. This may increase a probability that one or another of the serving dishes depart from a desired configuration, which may result in waste or spoilage of a food item, environmental cleanup, or damage to a serving dish.

Humans and other animal food consumers have a limited ability to handle multiple components of any physical system and to be taught, discover, or remember how multiple components of a physical system may work together. This may be particularly true in contexts in which a first person, such as a parent or other caregiver, is caring for a second or a plurality of other persons, such as children or dependents. The first person may be subject to a large number of competing and urgent demands on such party's time, attention, and organizational abilities. This problem becomes even more acute when a plurality of people act as caregivers and need to coordinate among the group of caregivers to keep multiple components of a physical system clean, organized, in working order, and available to be used.

Figure 1A:
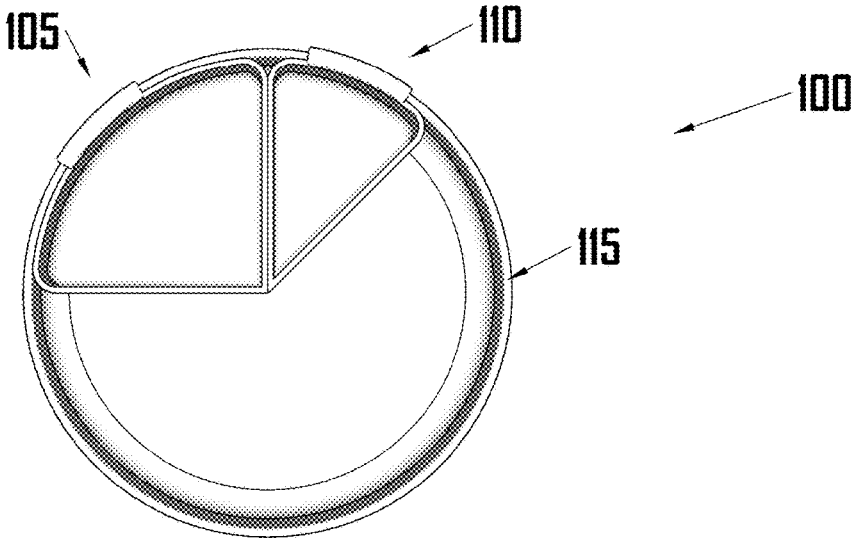
FIG. 1A is a top perspective projection of a plate, quadrant serving section, and octant serving section incorporated with teachings of the present disclosure, according to some embodiments.

Although the following Detailed Description will proceed with reference being made to illustrative embodiments, many alternatives, modifications, and variations thereof will be apparent to those skilled in the art.

DETAILED DESCRIPTION

Following are defined terms in this document.

As used herein, the term "parallel projection" refers to projection of an object in three-dimensional space onto a fixed plane, known as a projection plane or image plane, where rays, known as lines of sight or projection lines, are parallel to each other.

As used herein, the term "perspective projection" refers to projection of an object in three-dimensional space onto a fixed plane, known as a projection plane or image plane, where rays, lines of sight, or projection lines, converge toward a "vanishing point".

As used herein, the term "isomorphic projection" refers to a perspective projection, in which three coordinate axes of three-dimensional space appear in the image plane to be equally foreshortened and the angle between any two of them is 120 degrees.

Singular references herein to one element in the drawings or to any object or noun shall be understood to refer to one or more, unless the context makes clear otherwise.

As used herein, a "circular sector" or "circle sector", is a portion of a disk enclosed by two radii and an arc, where the smaller enclosed area is known as the minor sector and the larger is known as the major sector. Unless otherwise noted, references herein to "circular sector" refer to a minor sector.

As used herein "releasable", "connect", "connected", "connectable", "disconnect", "disconnected," and "disconnectable" refers to two or more structures which may be connected or disconnected, generally without the use of tools (examples of tools including screwdrivers, pliers, drills, saws, welding machines, torches, irons, and other heat sources) or with the use of tools but in a repeatable manner (such as through the use of nuts and bolts or screws). As used herein, "attach," "attached," or "attachable" refers to two or more structures or components which are attached through the use of tools or chemical or physical bonding, but wherein the structures or components may not generally be released or re-attached in a repeatable manner. As used herein, "secure," "secured," or "securable" refers to two or more structures or components which are connected or attached.

In overview, this disclosure relates to a plate and one or more removable nested serving sections (also referred to as a "serving section"), wherein the serving section may be attached to and released from the plate and wherein the serving section occupies a circular sector of the plate. The plate and serving section allow multiple items of food to be served to a consumer, with one or more items placed in a nested serving section. The serving section may keep food items in such serving section separate from food items on the plate or in another serving section.

In embodiments, the nested serving section may comprise a lid. The lid may comprise a friction fitting with a base of the serving section. The lid may comprise a flange. The lid may be friction connected to the base of the serving section by a downward force vector applied to the lid by, for example, an adult human, without the use of tools. The lid may be disconnected from the base of the serving section by an upward force vector on the flange, on a side or bottom edge of the lid or the like, from, for example, an adult human, without the use of tools.

The nested serving section comprises clasp components, discussed herein, that allow the serving section to be friction fitted to the plate. The clasp allows the serving section to be press fit or connected to the plate by a downward force vector applied to the serving section from, for example, an adult human, without the use of tools. The clasp allows the serving section to be disconnected from the plate by an upward force vector on the clasp, on a side or bottom of the serving section or the like, from, for example, an adult human, without the use of tools.

The serving section may, therefore, be secured to the plate by the clasp and may resist upset of or may stabilize the serving section and food items therein. Stabilizing the serving section and food items therein may be desirable when the plate and serving section are transported and/or when food is consumed from the plate and serving section.

One or more serving section may be removed from and secured to the plate for purposes of portioning food, for purposes of keeping hot food in a first serving section away from cooler food on the plate or in a second serving section or for purposes of keeping cool or cold food away from warmer food, for purposes of reheating food in such serving section in a microwave or in another heater, for storage, for allocation to a different consumer, for aesthetic purposes, or other reasons.

As noted, the serving section occupies a circular sector of the plate. The angle of arc or arc angle of the circular sector, between the two radii, is variable. An embodiment is illustrated in FIG. 1 in which the circular sector of quadrant serving section 105 is a quadrant of the plate or, in other words, in which the arc angle of the circular sector of quadrant serving section 105 is 90 degrees. An embodiment is also illustrated in FIG. 1 in which the circular sector of serving section 110 is an octant of the plate or, in other words, in which the arc of the circular sector of serving section 110 is 45 degrees. Other arc angles are possible; the illustrated arc angles are by way of example.

The serving section may comprise a rounded point or "nose" which approaches a center of the plate. The nose may be safe, aesthetically pleasing, and easier to fabricate and remove from a mold than a sharp point. Because the serving section is a circular sector, and because the nose is designed not to protrude through the two radii of the circular sector as the radii approach the center of the plate, a plurality of serving sections may be rotated relative to one another on the plate, without noses of adjoining serving sections bumping into or otherwise interfering with one another as the serving sections are rotated. If the nose protruded through one or both of the radii of the circular sector, then the noses would bump into one another and would preclude placing the serving sections immediately adjacent to one another; this is discussed in relation to FIG. 13. The distance of the nose from the center of the plate is determined by factors such as the angle of the arc between the two radii of the circular sector and the curvature of the nose or the radius of curvature of the nose.

A plurality of serving sections may be secured to or otherwise be used together on one plate. Serving sections may be rotated about the center of the plate, such as by overcoming friction produced by a clasp of a serving section and rotating the serving section, or by releasing the clasp of one serving section from the plate, rotating it to a new position, and securing the clasp of the one serving section to the plate in the new position.

In this way, the disclosed plate and serving section form an aesthetically pleasing and functional serving dish, wherein serving sections of the serving dish keep separate food items separate, and wherein the plate and serving sections may be used together or separately for food preparation, delivery, handling, consumption, reheating and cooling, and/or storage. An adult human may quickly learn how to use, understand and reconfigure a serving dish system formed from the disclosed plate and serving section, notwithstanding that the serving dish system may provide a range of services.

FIG. 1A is a top perspective projection of plate 115, a first or quadrant serving section 105, and a second or octant serving section 110 incorporated with teachings of the present disclosure, according to some embodiments. In the example illustrated in FIG. 1, quadrant serving section 105 and octant serving section 110 are secured to plate 115 by clasps (described further herein). Together plate 115, quadrant serving section 105, and octant serving section 110 may be referred to as serving dish 100. As illustrated in FIG. 1A, the quadrant and octant serving sections may be secured to the plate in such a manner that arcs of each serving section abut; however, this is only one example. The first, second, and n serving sections may be secured to the plate in a configuration in which arcs of the serving sections do not abut. As noted, quadrant serving section 105 and octant serving section 110 are examples of serving sections in which the central arc of the circular sector of each serving section is, respectively, 90 and 45 degrees; serving sections with a different central arc may be fabricated.

Plate and serving sections may be formed from plastics, metals, composite materials, and the like. Urethane, rubber, or another rubber-like material may also be used, such as with respect to skid pads (discussed further herein), friction pads, to enhance adhesion of clasp to plate, or, such as with high durometer urethane (above, for example, 80 durometer), instead of or in addition to plastic or other materials.

Figure 1B:
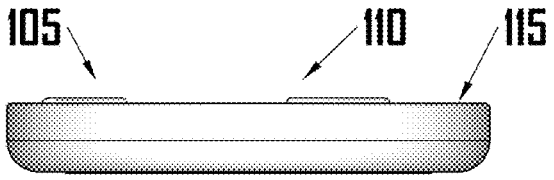
FIG. 1B is a front parallel projection of the plate, quadrant serving section, and octant serving section of FIG. 1A, incorporated with teachings of the present disclosure, according to some embodiments.

FIG. 1B is a front parallel projection of plate 115, quadrant serving section 105, and octant serving section 110 of FIG. 1A, incorporated with teachings of the present disclosure, according to some embodiments.

Figure 1C:
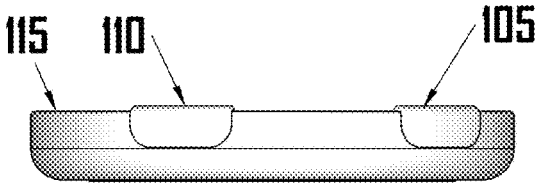
FIG. 1C is a back parallel projection of the plate, quadrant serving section, and octant serving section of FIG. 1A, incorporated with teachings of the present disclosure, according to some embodiments.

FIG. 1C is a back parallel projection of plate 115, quadrant serving section 105, and octant serving section 110 of FIG. 1A, incorporated with teachings of the present disclosure, according to some embodiments.

Figure 1D:
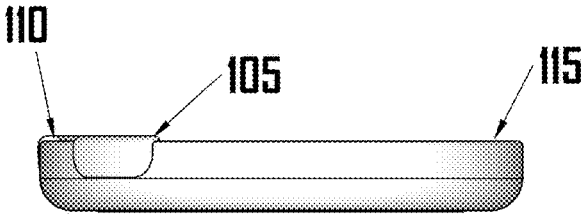
FIG. 1D is a left side parallel projection of the plate, quadrant serving section, and octant serving section of FIG. 1A, incorporated with teachings of the present disclosure, according to some embodiments.

FIG. 1D is a left side parallel projection of plate 115, quadrant serving section 105, and octant serving section 110 of FIG. 1A, incorporated with teachings of the present disclosure, according to some embodiments.

Figure 1E:
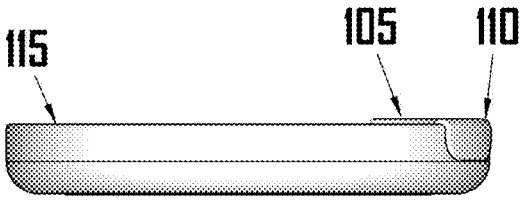
FIG. 1E is a right side parallel projection of the plate, quadrant serving section, and octant serving section of FIG. 1A, incorporated with teachings of the present disclosure, according to some embodiments.

FIG. 1E is a right side parallel projection of plate 115 and octant serving section 110 of FIG. 1A, incorporated with teachings of the present disclosure, according to some embodiments.

Figure 2A:
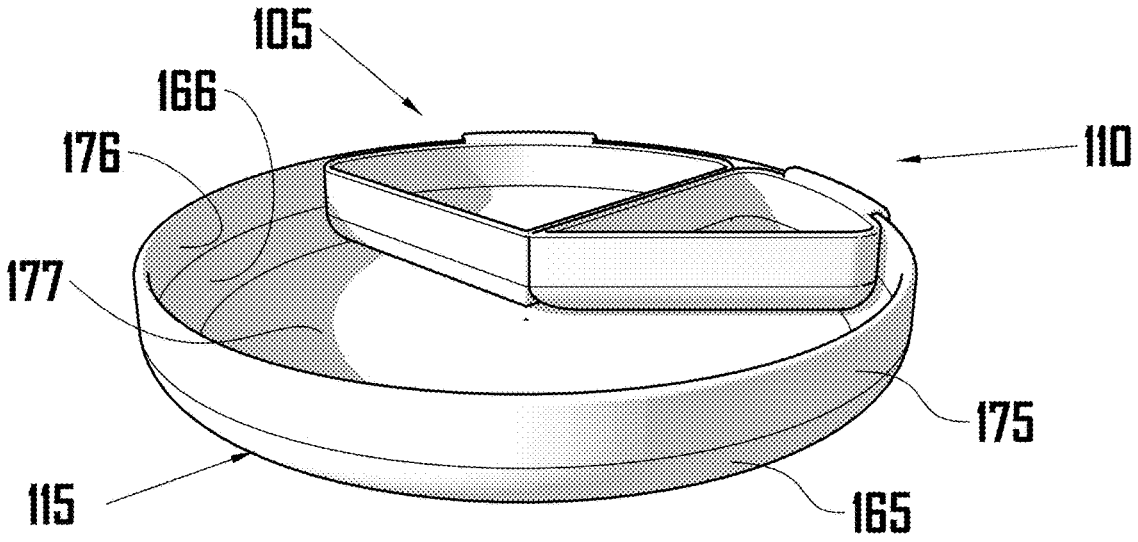
FIG. 2A is a top isomorphic perspective projection of the plate, quadrant serving section, and octant serving section of FIG. 1A, incorporated with teachings of the present disclosure, according to some embodiments.

FIG. 2A is a top isomorphic perspective projection of plate 115, quadrant serving section 105, and octant serving section 110 of FIG. 1A, incorporated with teachings of the present disclosure, according to some embodiments. FIG. 2A labels exterior plate hip 165, interior plate hip 166, exterior curved vertical wall 175, interior curved vertical wall 176, and interior plate base 177 of plate 115, into which quadrant serving section 105 and octant serving section 110 have been friction fitted (as discussed further herein).

As illustrated in this example, a cross section of exterior plate hip 165 is a quarter of a circular arc centered on a point above exterior plate base 170, wherein such point is approximately 13.5 mm above exterior plate base 170 and 10 mm above interior plate base 177. When extended around the perimeter of plate 115, such quarter of the circular arc forms exterior plate hip 165. As illustrated in this example, a cross section of interior plate hip 166 is a quarter of a circular arc centered on a point above interior plate base 171, wherein such point is approximately 10 mm above interior plate base 171 and is the same point as for exterior plate hip 165. When extended around the perimeter of plate 115, such quarter of the circular arc forms interior plate hip 166. The distance between i) interior plate hip 166 and exterior plate hip 165, ii) interior plate base 171 and exterior plate base 170, and iii) exterior curved vertical wall 175 and interior curved vertical wall 176 is approximately 3.5 mm. As illustrated in this example, a thickness of plate 115 is uniformly and approximately 3.5 mm.

Figure 2B:
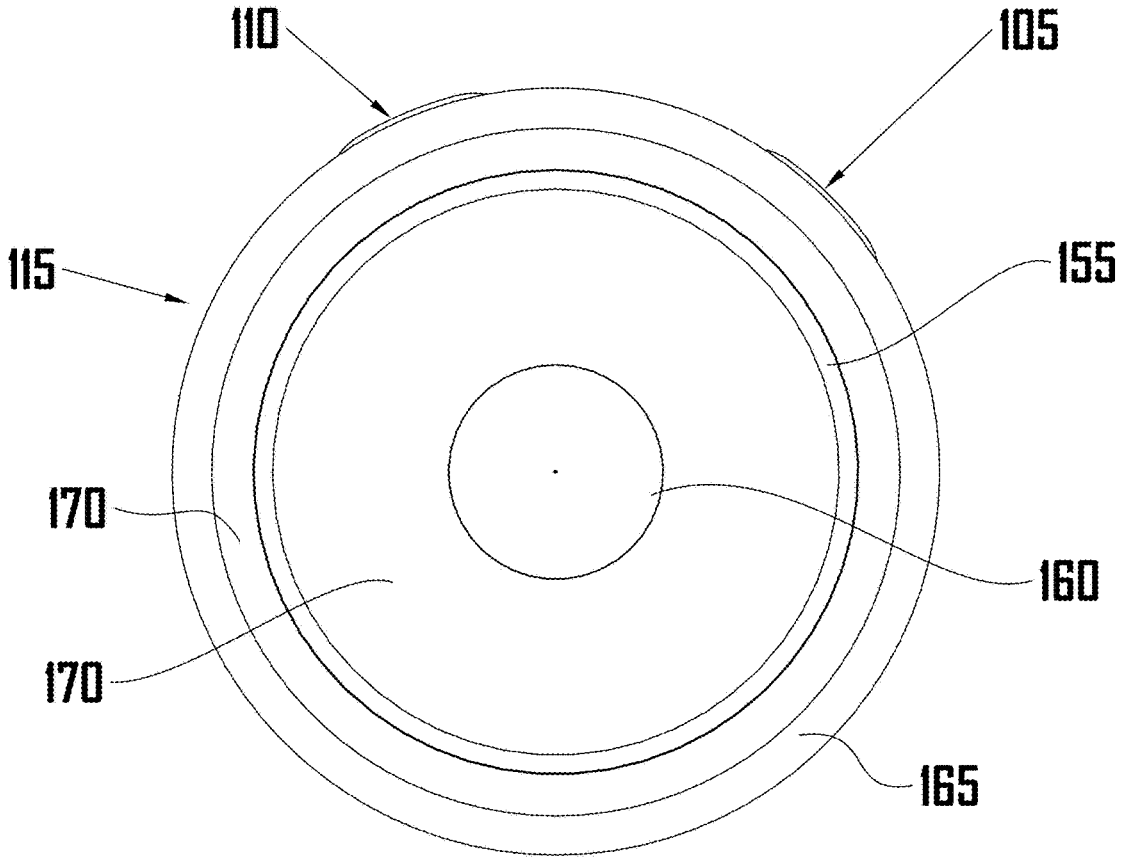
FIG. 2B is a bottom perspective projection of the plate, quadrant serving section, and octant serving section of FIG. 1A, incorporated with teachings of the present disclosure, according to some embodiments.

FIG. 2B is a bottom perspective projection of plate 115, quadrant serving section 105, and octant serving section 110 of FIG. 1A, incorporated with teachings of the present disclosure, according to some embodiments. FIG. 2B includes exterior plate base 170, which may generally be flat. FIG. 2B includes inner anti-skid pad 160 and outer anti-skid pad 155. The anti-skid pads and/or friction pads discussed herein may comprise a rubbery material, such as rubber, silicone rubber, latex, urethane, neoprene, an elastomer, a flexible cross-linked polymer, a material with a low Shore durometer (75 or below), or the like. The anti-skid pads may assist in stabilizing a plate and serving section serving dish system on a surface, such as a table.

Figure 3A:
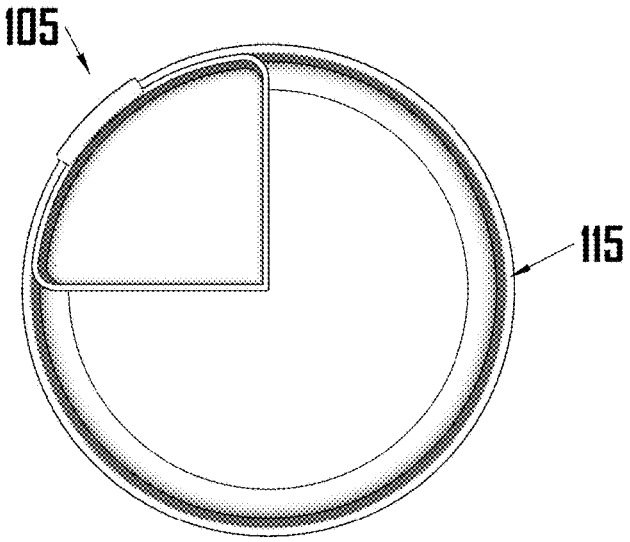
FIG. 3A is a top perspective projection of the plate and quadrant serving section of FIG. 1A incorporated with teachings of the present disclosure, according to some embodiments.

FIG. 3A is a top perspective projection of plate 115 and quadrant serving section 105 of FIG. 1A incorporated with teachings of the present disclosure, according to some embodiments. FIG. 3A illustrates that plate 115 may be used with one serving section.

Figure 3B:
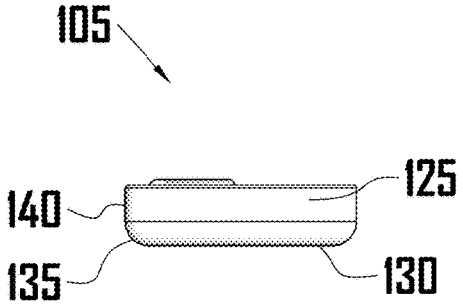
FIG. 3B is a front parallel projection of the quadrant serving section of FIG. 3A, incorporated with teachings of the present disclosure, according to some embodiments.
Figure 3C:
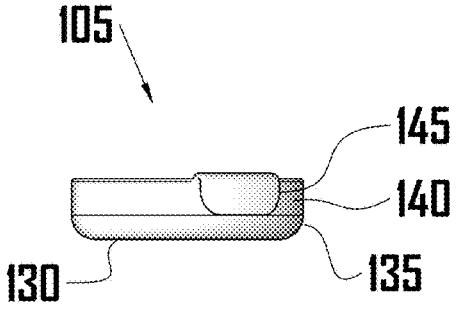
FIG. 3C is a back parallel projection of the quadrant serving section of FIG. 3A, incorporated with teachings of the present disclosure, according to some embodiments.
Figure 3D:
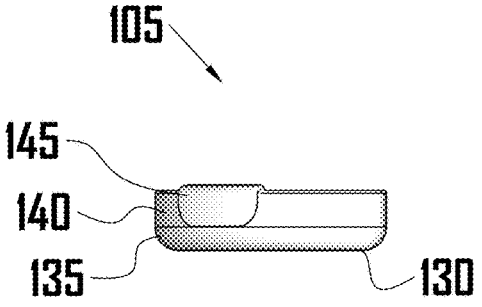
FIG. 3D is a left side parallel projection of the quadrant serving section of FIG. 3A, incorporated with teachings of the present disclosure, according to some embodiments.
Figure 3E:
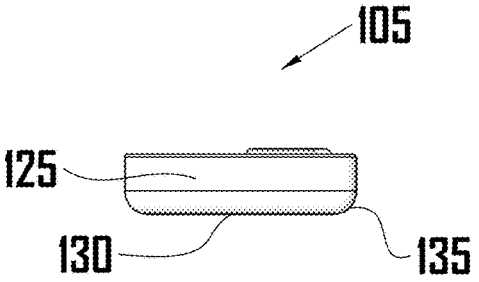
FIG. 3E is a right side parallel projection of the quadrant serving section of FIG. 3A, incorporated with teachings of the present disclosure, according to some embodiments.

FIG. 3B is a front parallel projection of quadrant serving section 105 of FIG. 3A. FIG. 3C is a back parallel projection of quadrant serving section 105 of FIG. 3A. FIG. 3D is a left side parallel projection of quadrant serving section 105 of FIG. 3A. FIG. 3E is a right side parallel projection of quadrant serving section 105 of FIG. 3A. FIGS. 3B through 3E include embodiments of clasp 145, vertical radius wall 125, vertical arc wall 140, arc hip 135, and serving section base 130. When quadrant serving section 105 is friction fitted to plate 115, arc hip 135 of quadrant serving section 105 may fit snuggly against interior plate hip 166 while vertical arc wall 140 may fit snuggle against interior curved vertical wall 176 of plate 115.

Figure 4A:
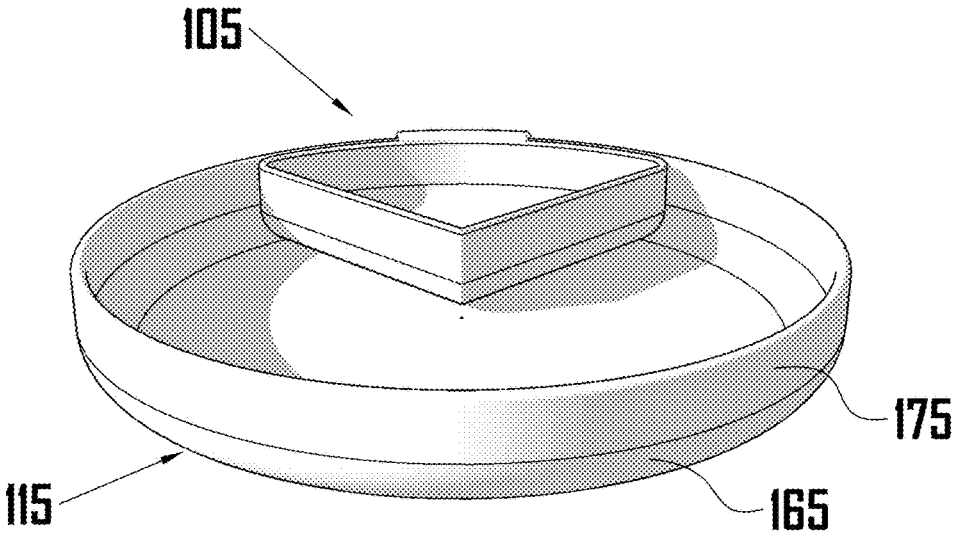
FIG. 4A is a top isomorphic perspective projection of the plate and quadrant serving section of FIG. 3A, incorporated with teachings of the present disclosure, according to some embodiments.
Figure 4B:
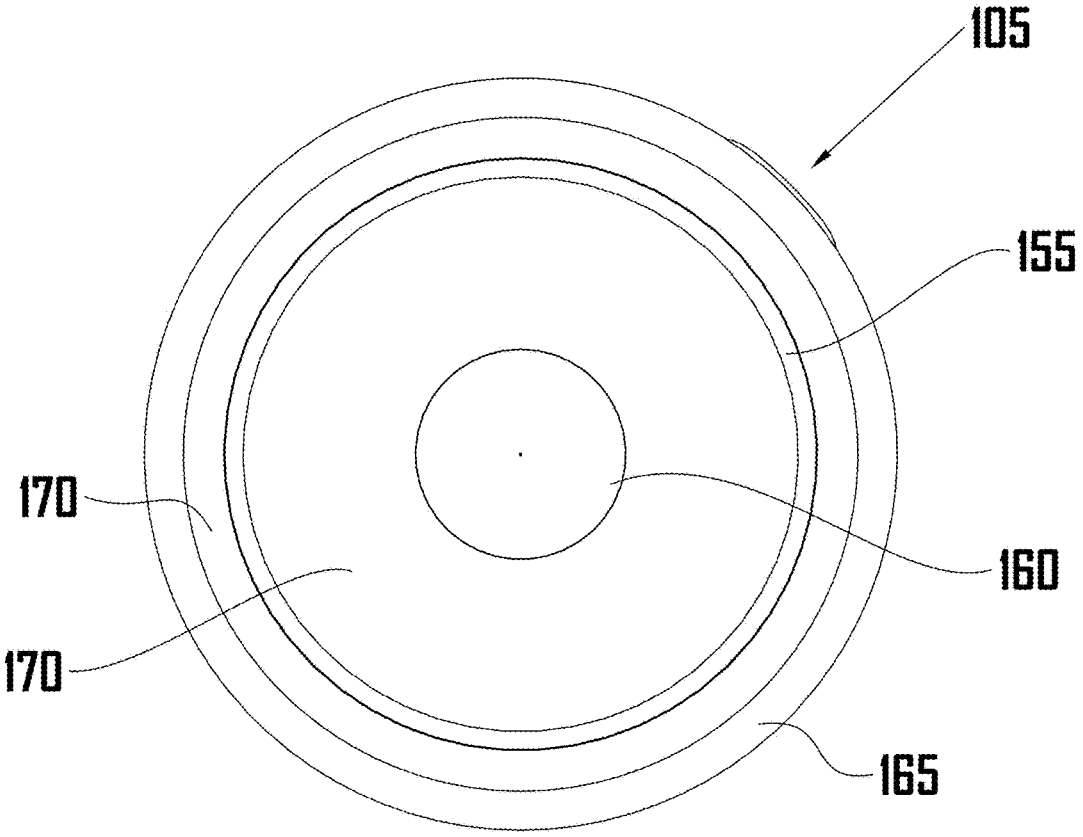
FIG. 4B is a bottom perspective projection of the plate and quadrant serving section of FIG. 3A, incorporated with teachings of the present disclosure, according to some embodiments.

FIG. 4A is a top isomorphic perspective projection of plate 115 and quadrant serving section 105 of FIG. 3A incorporated with teachings of the present disclosure, according to some embodiments. FIG. 4B is a bottom perspective projection of the plate and quadrant serving section of FIG. 3A. FIGS. 4A and 4B illustrate that plate 115 may be used with one serving section, such as quadrant serving section 105. FIGS. 4A and 4B provide another view angle with respect to quadrant serving section 105 and plate 115.

Figure 5A:
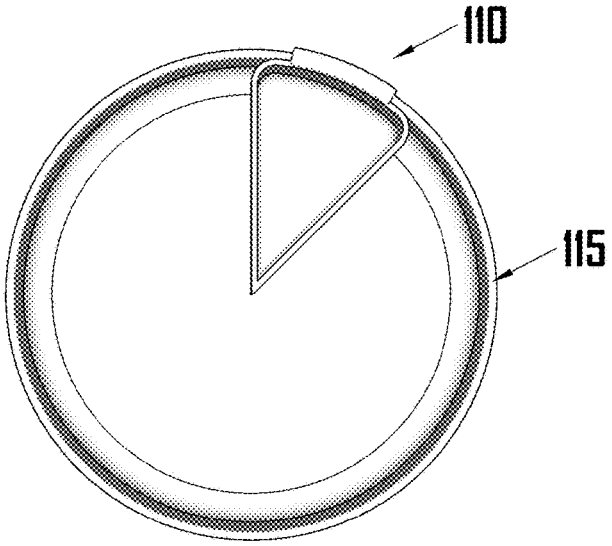
FIG. 5A is a top perspective projection of the plate and octant serving section of FIG. 1A, incorporated with teachings of the present disclosure, according to some embodiments.
Figure 5B:
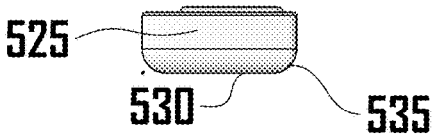
FIG. 5B is a front parallel projection of octant serving section of FIG. 5A, incorporated with teachings of the present disclosure, according to some embodiments.
Figure 5C:
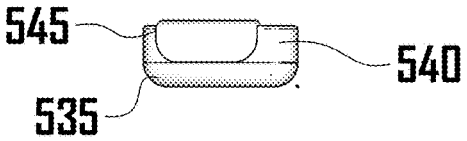
FIG. 5C is a back parallel projection of the octant serving section of FIG. 5A, incorporated with teachings of the present disclosure, according to some embodiments.
Figure 5D:
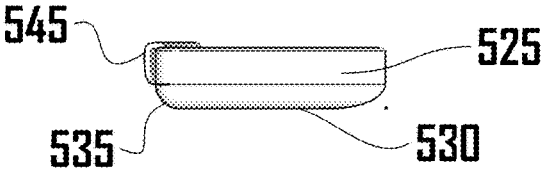
FIG. 5D is a left side parallel projection of the octant serving section of FIG. 5A, incorporated with teachings of the present disclosure, according to some embodiments.
Figure 5E:
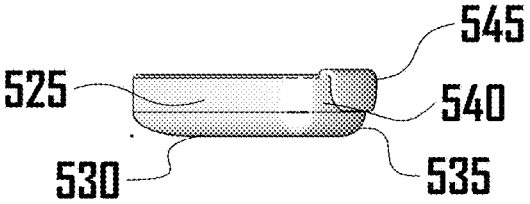
FIG. 5E is a right side parallel projection of the octant serving section of FIG. 5A, incorporated with teachings of the present disclosure, according to some embodiments.

FIG. 5A is a top perspective projection of plate 115 and octant serving section 110 of FIG. 1A incorporated with teachings of the present disclosure, according to some embodiments. FIG. 5B is a front parallel projection of octant serving section 110. FIG. 5C is a back parallel projection of octant serving section 110. FIG. 5D is a left side parallel projection of octant serving section 110. FIG. 5E is a right side parallel projection of octant serving section 110. FIGS. 5B through 5E include embodiments of clasp 545, vertical radius wall 525, vertical arc wall 540, arc hip 535, and serving section base 530.

Figure 6A:
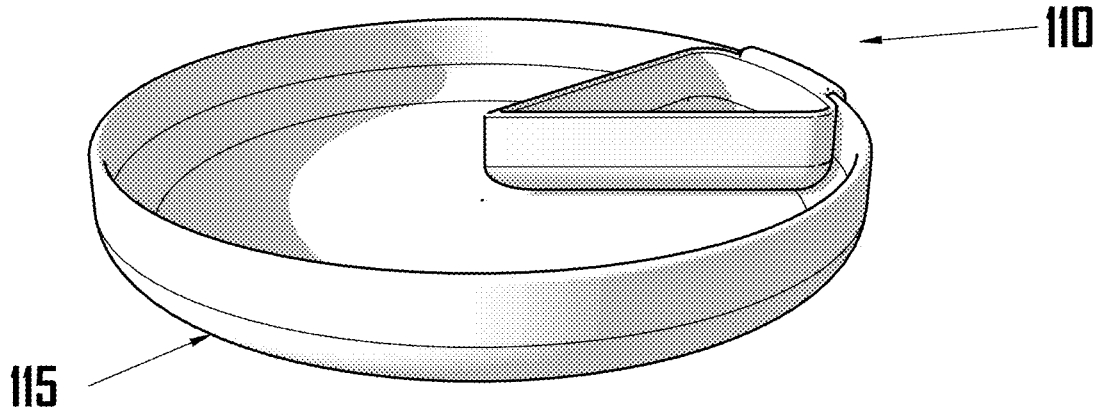
FIG. 6A is a top isomorphic perspective projection of the plate and octant serving section of FIG. 5A, incorporated with teachings of the present disclosure, according to some embodiments.
Figure 6B:
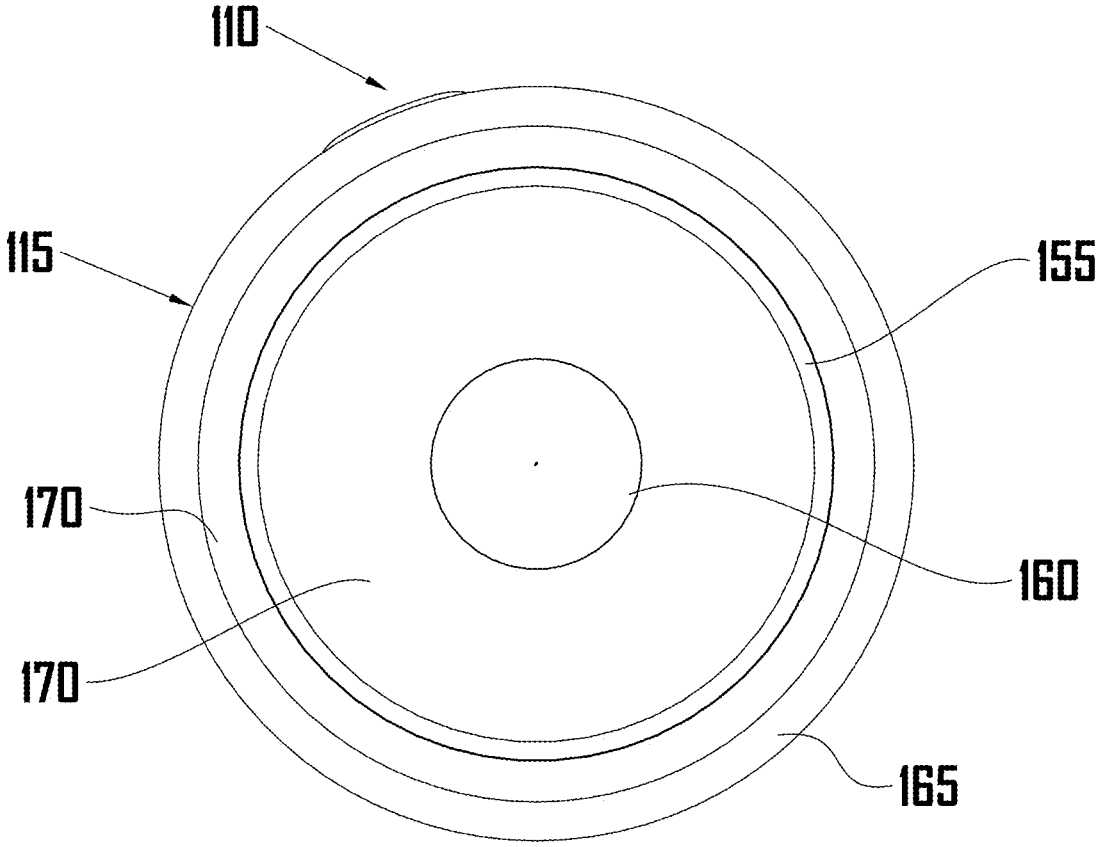
FIG. 6B is a bottom perspective projection of the plate and octant serving section of FIG. 5A, incorporated with teachings of the present disclosure, according to some embodiments.

FIG. 6A is a top isomorphic perspective projection of plate 115 and octant serving section 110 of FIG. 5A, incorporated with teachings of the present disclosure, according to some embodiments. FIG. 6B is a bottom perspective projection of plate 115 and octant serving section 110 of FIG. 5A. FIGS. 6A and 6B illustrate that plate 115 may be used with one serving section, such as octant serving section 110.

Figure 7A:
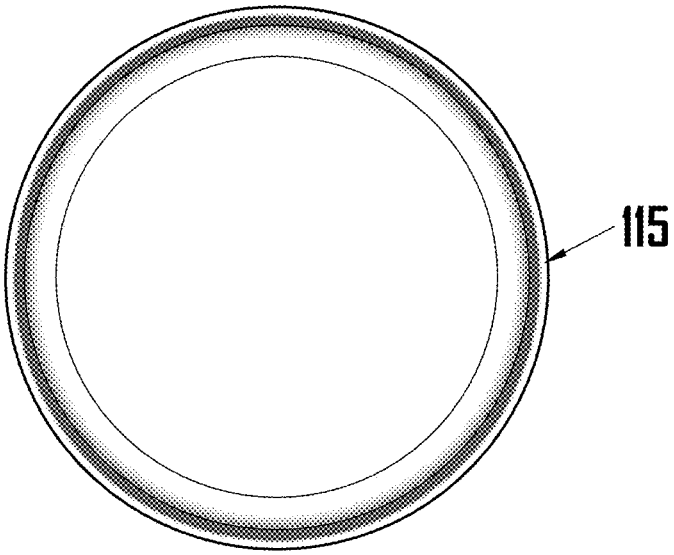
FIG. 7A is a top perspective projection of the plate of FIG. 1A incorporated with teachings of the present disclosure, according to some embodiments.
Figure 7B:
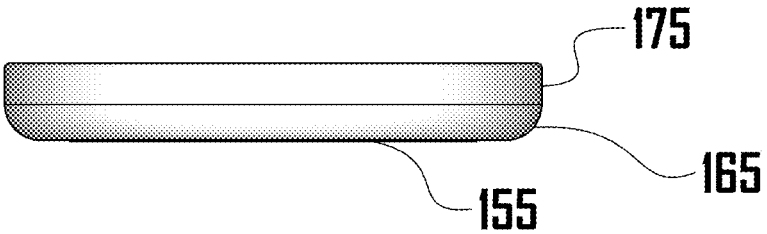
FIG. 7B is a front parallel projection of plate of FIG. 7A, incorporated with teachings of the present disclosure, according to some embodiments.

FIG. 7A is a top perspective projection of plate 115 of FIG. 1A incorporated with teachings of the present disclosure, according to some embodiments. FIG. 7B is a front parallel projection of plate 115 of FIG. 7A, incorporated with teachings of the present disclosure, according to some embodiments. Identified in FIG. 7B are exterior curved vertical wall 175 of plate 115, exterior plate hip 165, and outer anti-skid pad 155. Anti-skid pads, such as outer anti-skid pad 155 and inner anti-skid pad 160 may protrude from exterior plate base 170, such as on the order of 0.5 mm.

Figure 8A:
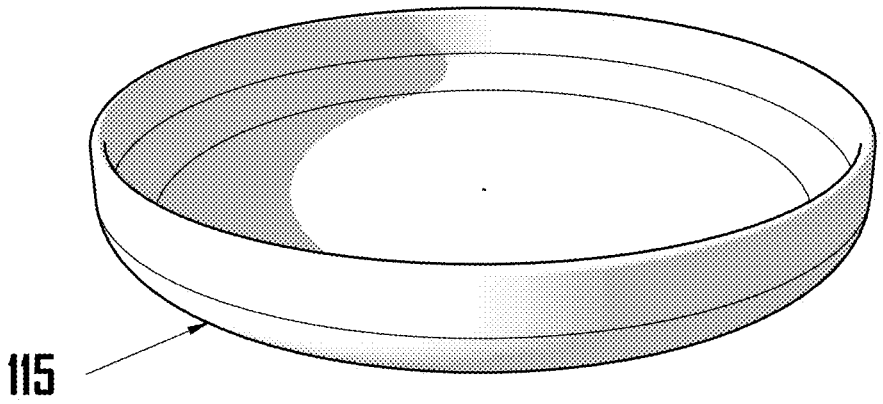
FIG. 8A is a top isomorphic perspective projection of the plate of FIG. 7A, incorporated with teachings of the present disclosure, according to some embodiments.

FIG. 8A is a top isomorphic projection of plate 115 of FIG. 7A, incorporated with teachings of the present disclosure, according to some embodiments.

Figure 8B:
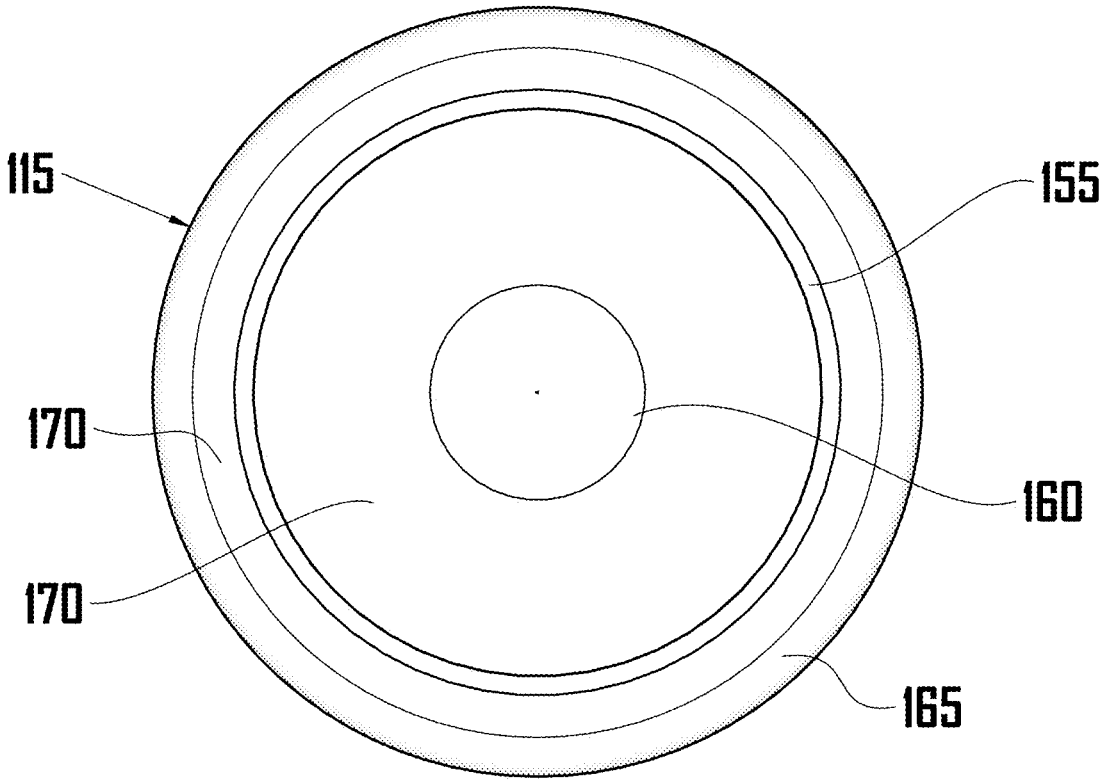
FIG. 8B is a bottom perspective projection of the plate of FIG. 8A, incorporated with teachings of the present disclosure, according to some embodiments.

FIG. 8B is a bottom perspective projection of plate 115 of FIG. 8A, incorporated with teachings of the present disclosure, according to some embodiments.

Figure 9B:
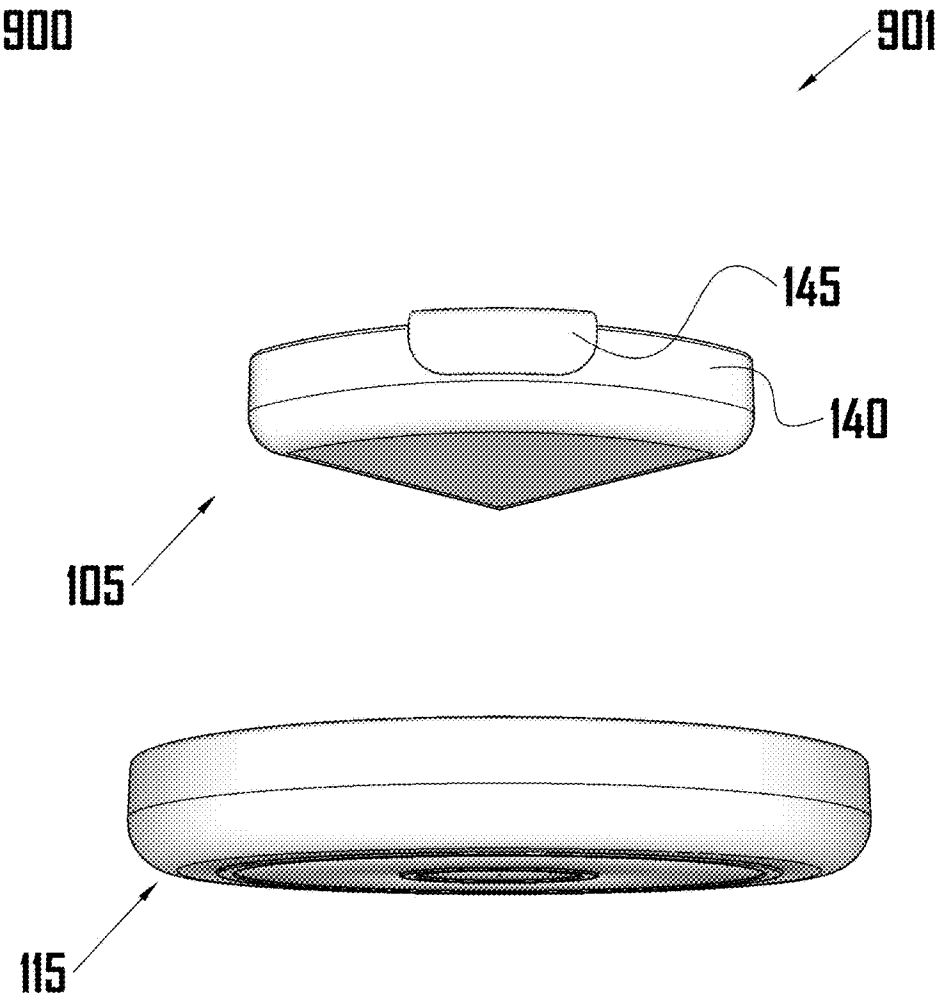
FIG. 9B is a back isomorphic perspective projection of the exploded plate and quadrant serving section of FIG. 9A, incorporated with teachings of the present disclosure, according to some embodiments.
Figure 9A:
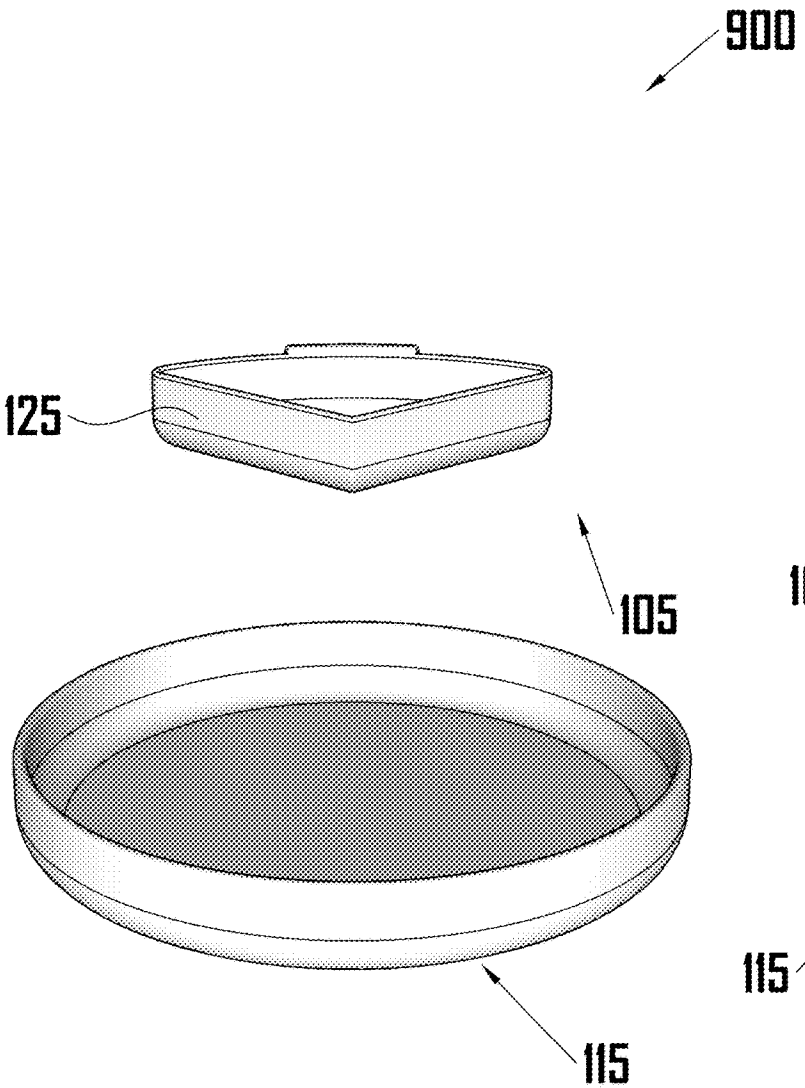
FIG. 9A is a front isomorphic perspective projection of an exploded plate and quadrant serving section, incorporated with teachings of the present disclosure, according to some embodiments.

FIG. 9A is a front isomorphic perspective projection of exploded plate 115 and quadrant serving section 105, incorporated with teachings of the present disclosure, according to some embodiments. Certain elements discussed in relation to other of the figures are labeled in FIG. 9A, such as vertical radius wall 125 and plate 115.

FIG. 9B is a back isomorphic projection of exploded plate 115 and quadrant serving section 105 of FIG. 9A, incorporated with teachings of the present disclosure, according to some embodiments.

FIGS. 9A and 9B illustrate another view of clasp 145 on an arc perimeter of quadrant serving section 105. In the examples illustrated herein, components of octant serving section 110 may be similar to components of quadrant serving section 105 illustrated by way of example in FIGS. 9A and 9B.

Figure 10A:
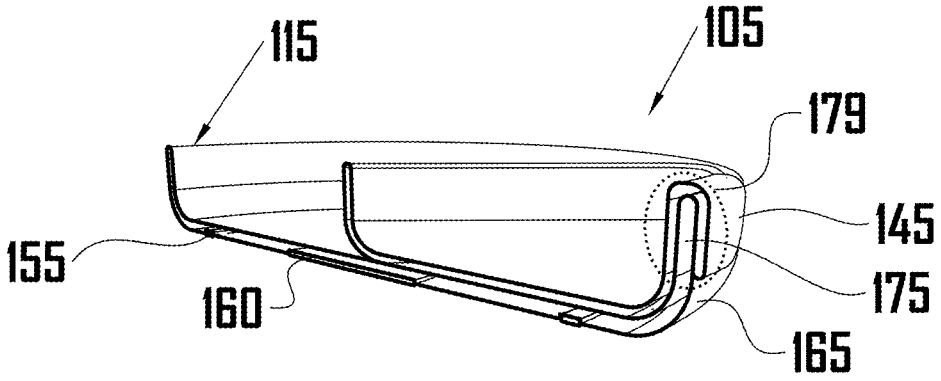
FIG. 10A is a perspective projection of a plate and quadrant serving section from above, with a cross-section through a midline thereof, incorporated with teachings of the present disclosure, according to some embodiments.

FIG. 10A is a perspective projection of plate 115 and quadrant serving section 105 slightly from above, with a cross-section through a midline thereof, incorporated with teachings of the present disclosure, according to some embodiments. FIG. 10A illustrates an example of clasp 145, forming a friction fitting 179 with plate 115. Clasp 145 overlaps plate 115 and extends down plate 115 approximately the same distance as curved vertical wall 175.

Figure 10B:
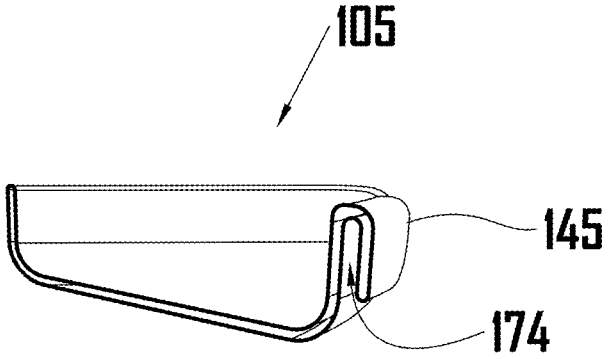
FIG. 10B is a perspective projection of the quadrant serving section of FIG. 10A, with a cross-section through a midline thereof, incorporated with teachings of the present disclosure, according to some embodiments.

FIG. 10B is a perspective projection of quadrant serving section 105 of FIG. 10A, with a cross-section through a midline thereof, incorporated with teachings of the present disclosure, according to some embodiments. Viewed in conjunction with FIG. 10A, FIG. 10B illustrates the example of clasp 145 and clasp negative space 174. Clasp negative space 174 is sized to fit around exterior curved vertical wall 175 of plate 115, forming friction fitting 179 with plate 115. Friction fitting 179 with plate 115 may be overcome by grasping quadrant serving section 105 and pulling quadrant serving section 105 up from plate 115, by inserting a lever, such as a knife or fork, between quadrant serving section 105 and plate 115 and prying the two apart, and/or by application of a force vector upward on clasp 145.

Figure 11A:
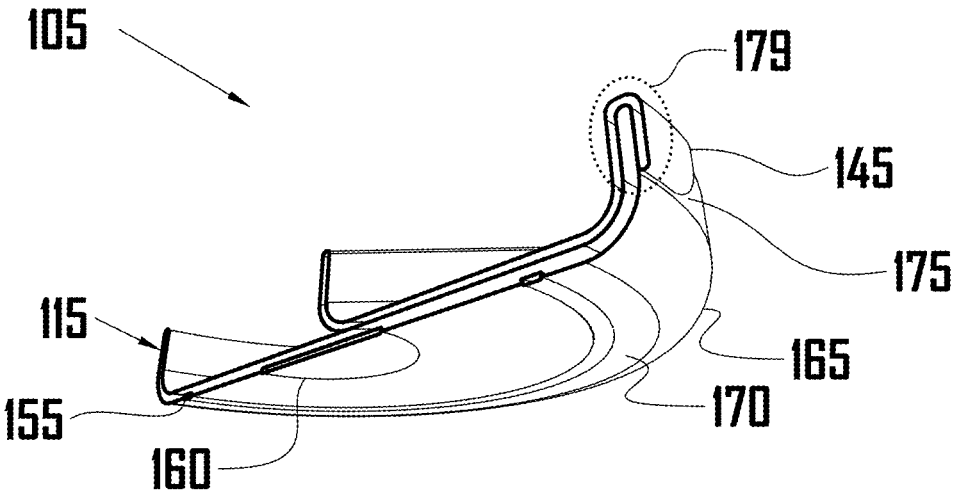
FIG. 11A is a perspective projection of a plate and quadrant serving section from below, with a cross-section through a midline thereof, incorporated with teachings of the present disclosure, according to some embodiments.

FIG. 11A is a perspective projection of plate 115 and quadrant serving section 105 from below, with a cross-section through a midline thereof, incorporated with teachings of the present disclosure, according to some embodiments. FIG. 11A illustrates another view of clasp 145, forming friction fitting 179 with plate 115. Together with FIG. 11B, FIG. 11A also identifies lid-serving section base seat 181. Lid-serving section base seat 181 comprises serving section flange 180 which fits into lid-channel 182, as discussed herein.

Figure 11B:
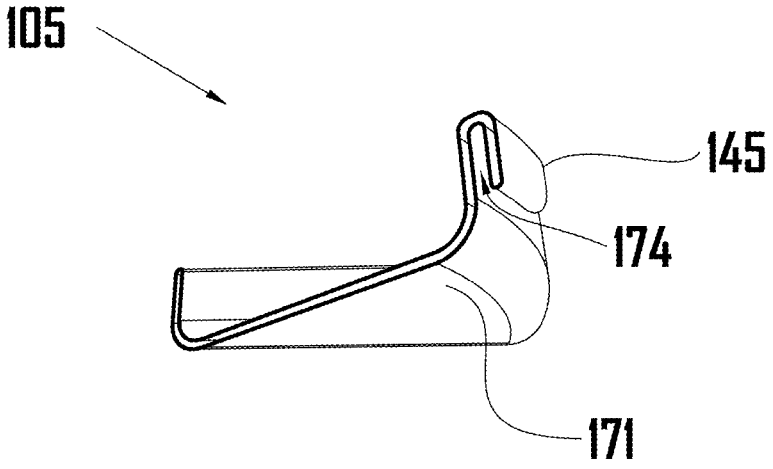
FIG. 11B is a perspective projection of the quadrant serving section of FIG. 11A from below, with a cross-section through a midline thereof, incorporated with teachings of the present disclosure, according to some embodiments.

FIG. 11B is a perspective projection quadrant serving section 105 of FIG. 11A, with a cross-section through a midline thereof, incorporated with teachings of the present disclosure, according to some embodiments. FIG. 11B provides another perspective of components of a serving dish system comprising a plate and nested serving section, one in which the underside of clasp 145 and clasp negative space 174 may be easier to view.

Figures 12A, 12B:
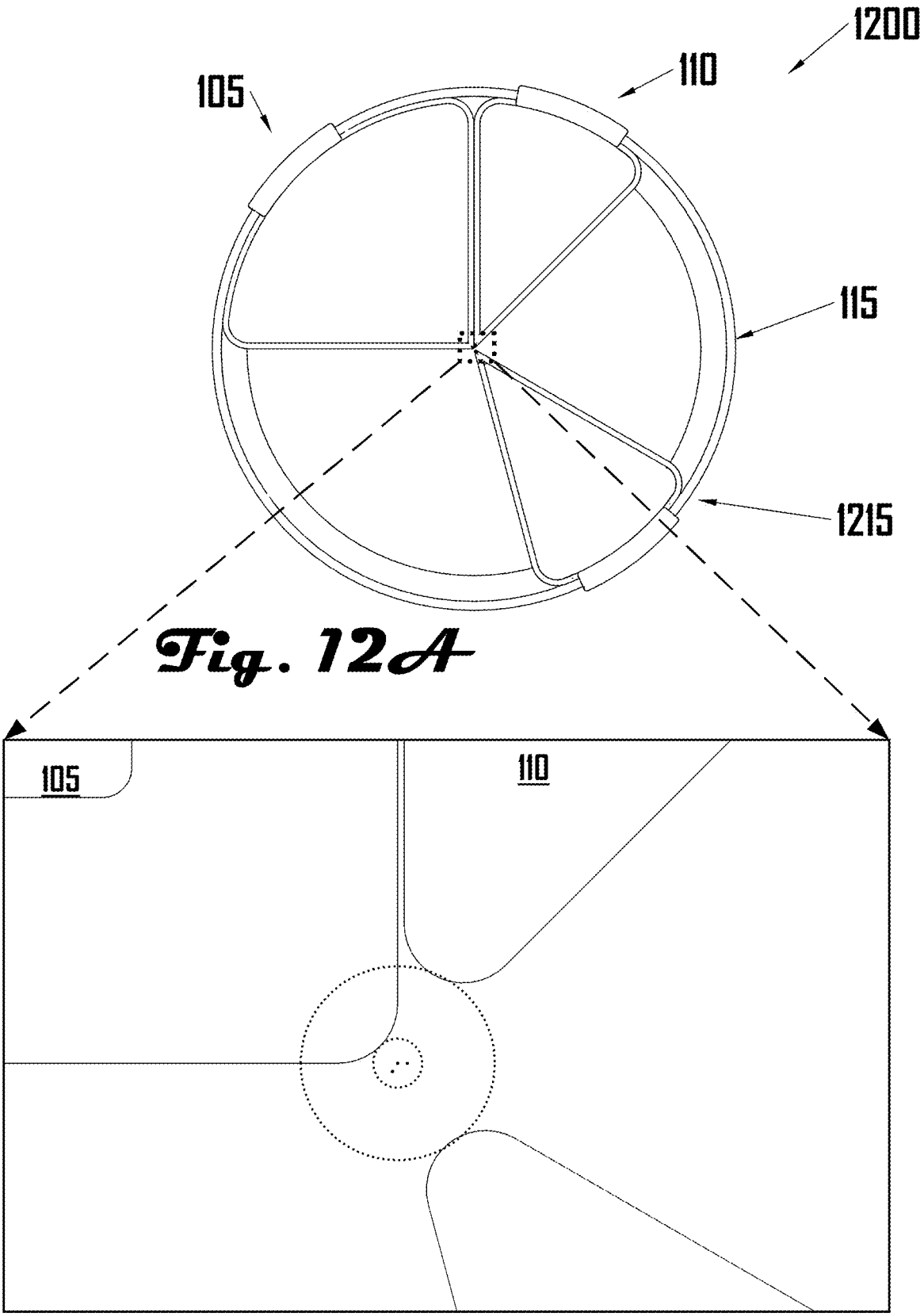
FIG. 12A is a top parallel projection of a plate, a first, a second, and a third serving section incorporated with teachings of the present disclosure, according to some embodiments.
FIG. 12B is a detail of the top parallel projection of the plate, first, second, and third serving section incorporated with teachings of the present disclosure, according to some embodiments.

FIG. 12A is a top parallel projection of plate 115, quadrant serving section 105, octant serving section 110, and a third serving section 1215, incorporated with teachings of the present disclosure, according to some embodiments. FIG. 12A illustrates an example in which more than two serving sections are used and/or FIG. 12A illustrates that serving sections may be rotated, relative to a center of plate 115, without the noses of such serving sections interfering with one another.

FIG. 12B is a detail of the top parallel projection of plate 115, quadrant serving section 105, octant serving section 110, and third serving section 1215 incorporated with teachings of the present disclosure, according to some embodiments. FIG. 12B illustrates nose 1220 of quadrant serving section 105, nose 1217 of octant serving section 110, and nose 1225 of serving section 1215. When rotated about a center of plate, dotted line nose-path 1205 illustrates that nose 1220 follows a relatively tight path around center of plate 115 or that nose-path 1205 has a relatively small radius. When rotated about a center of plate, dotted line nose-path 1210 illustrates that nose 1217 follows a path around center of plate 115 that is further out or that nose-path 1210 has a larger radius than nose-path 1205.

Due to noses of the serving sections being rounded, and due to the sides of the serving sections staying within the radii of circular sectors, the noses of serving sections do not interfere or bump into one another as the serving sections are rotated about the center of the plate of the serving dish system.

Figure 13:
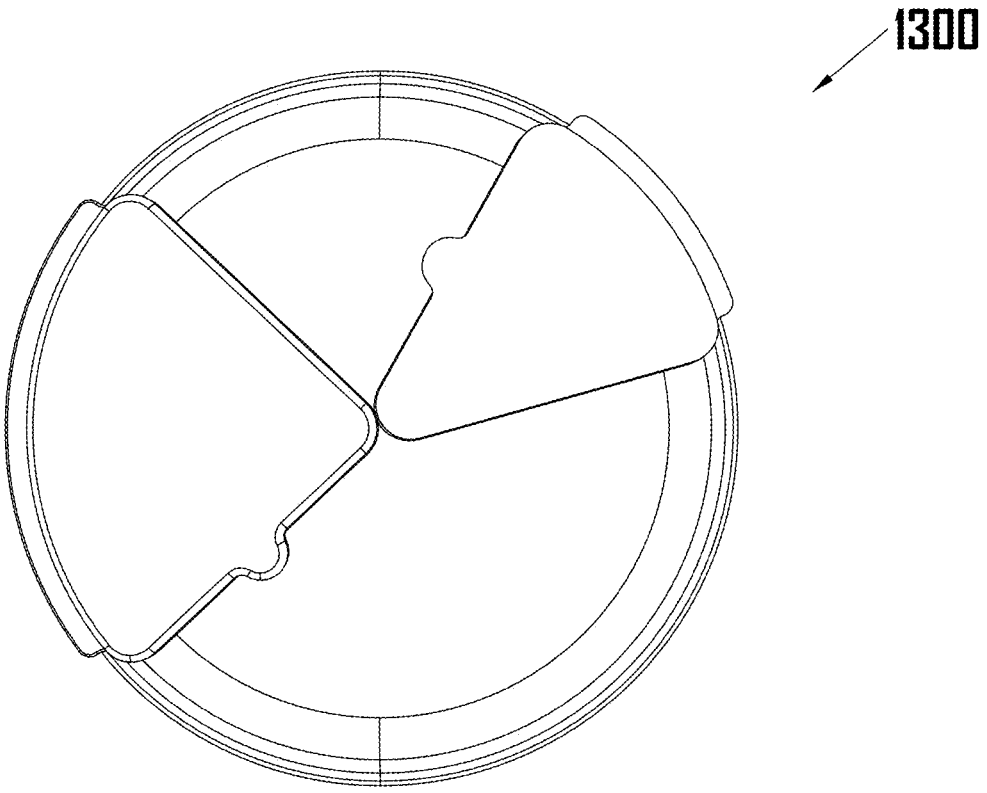
FIG. 13 is a top perspective projection of non- or partially-functional embodiments, provided to contrast with functional elements disclosed herein.

By way of contrast, FIG. 13 illustrates non- or partially functioning embodiments of plate and serving section embodiments in which the noses of the serving sections are rounded, but do not fit within circular sectors of the underlying plate. As a consequence, FIG. 13 illustrates the closest that the two serving sections can come to each other, before the noses bump into or interfere with one another. If the serving sections of FIG. 13 were rotated closer to one another, the clasps holding the serving sections to the plate would no longer be able to follow the curvature of the plate. Either the plate or the clasps would break if they were rotated closer together than as shown in FIG. 13. Said another way, the two serving sections in FIG. 13 cannot abut, side-to-side, as serving sections 105 and 110 are able to.

Figure 14B:
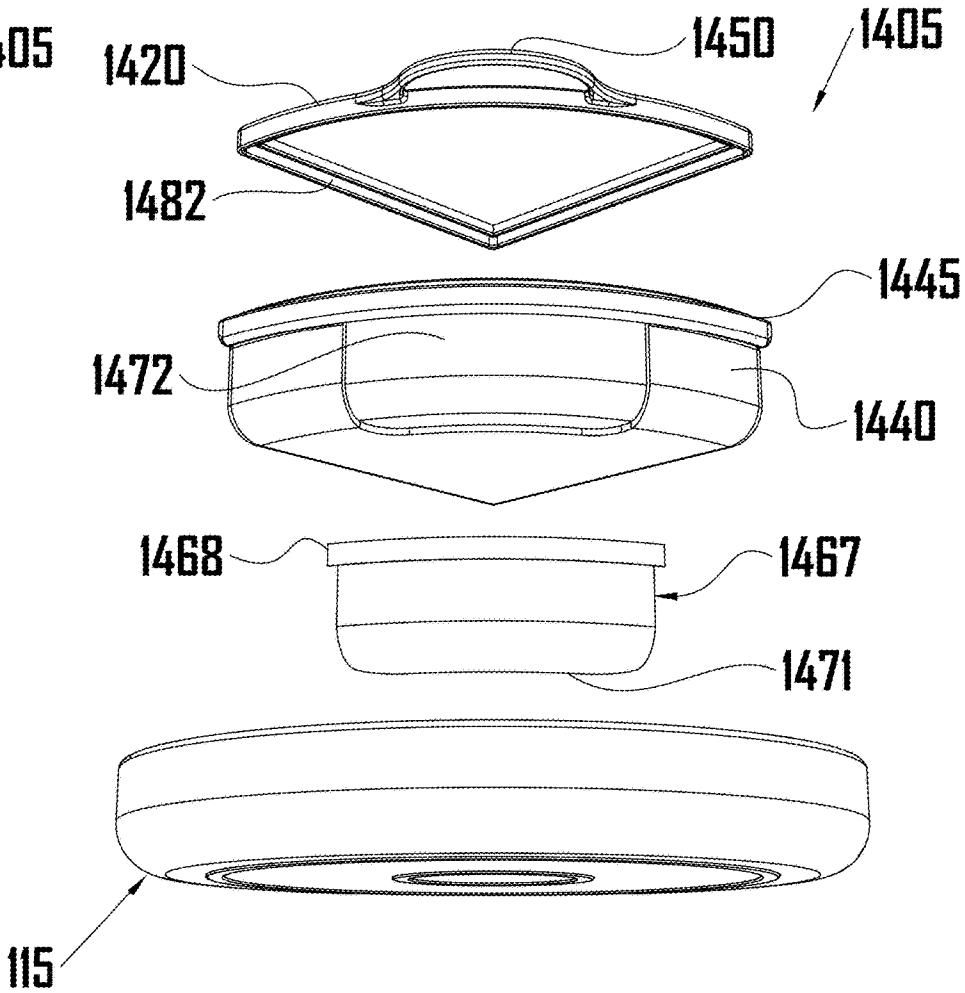
FIG. 14B is a back isomorphic perspective projection of the exploded plate and quadrant serving section of FIG. 14A, according to some embodiments.
Figure 14A:
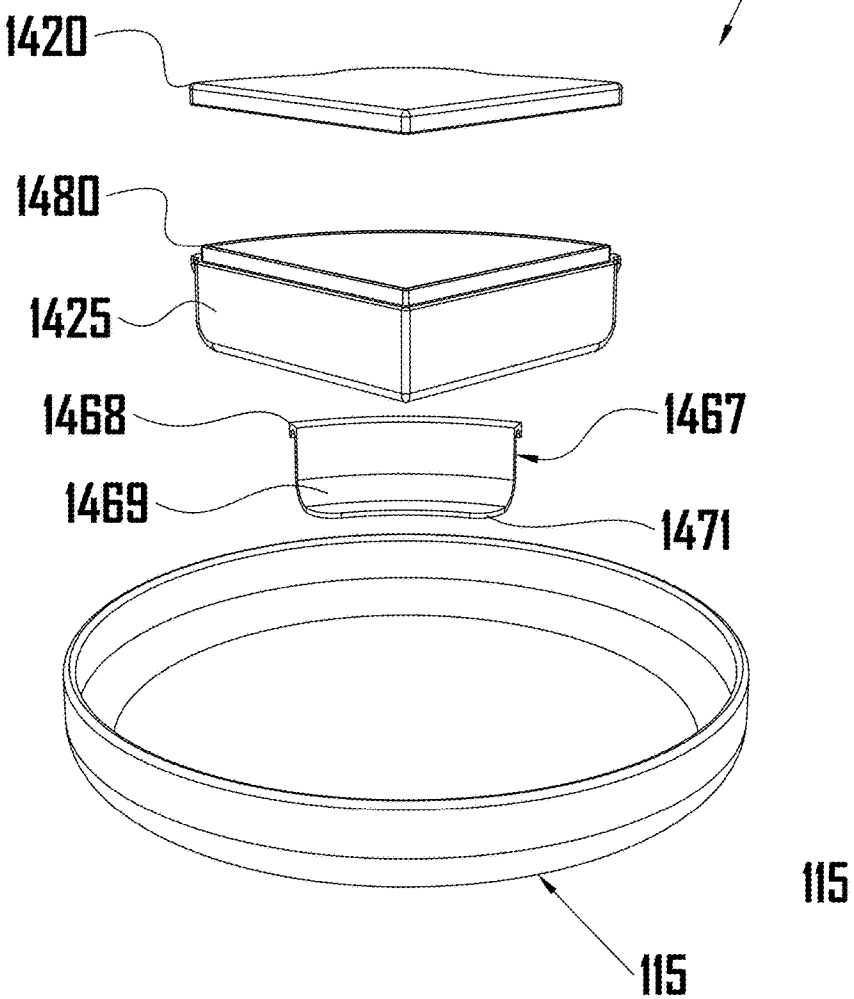
FIG. 14A is a front isomorphic perspective projection of an exploded plate and quadrant serving section, incorporated with teachings of the present disclosure and illustrating an embodiment of a friction fitting, according to some embodiments.

FIG. 14A is a front isomorphic perspective projection of an exploded plate 115 and quadrant serving section 1405, incorporated with teachings of the present disclosure and illustrating an alternative embodiment of a friction fitting, according to some embodiments.

FIG. 14B is a back isomorphic perspective projection of the exploded plate 115 and quadrant serving section of FIG. 14A, incorporated with teachings of the present disclosure and illustrating an alternative embodiment of a friction fitting, according to some embodiments.

FIGS. 14A and 14B illustrate an underside of lid 1420, clasp 1445 around an arc perimeter of quadrant serving section 1405, and friction pad 1467. In the example illustrated in FIGS. 14A and 14B, friction pad 1467 comprises friction insert base 1471, friction insert hip 1469, and friction insert clasp 1468. Friction pad 1467 may comprise a rubbery material, such as silicone rubber, natural rubber, urethane, or the like. Friction pad 1467 fits within friction insert negative space 1472 within quadrant serving section 1405. Friction pad 1467 may be bonded within friction insert negative space 1472, such as with an adhesive. Friction pad 1467 may be formed within negative space 1472, such as by molding. Other components of serving section 1405 may be similar to components of quadrant serving section 105 discussed herein.

Certain elements discussed in relation to other of the figures are similar to similarly named elements in other embodiments, such as vertical radius wall 1425, vertical arc wall 1440, and plate 1515.

FIGS. 14A and 14B illustrate an embodiment in which a friction fitting between a serving section and a plate is augmented by a rubbery material of a fiction insert, which may produce higher adhesion between plate and serving section.

FIGS. 14A and 14B illustrate an example of serving section flange 1480 and lid-channel 1482, into which serving section flange 1480 fits, forming a friction fitting. When lid 1420 and lid-channel 1482 is fitted to serving section flange 1480, a force vector may be applied to lid flange 1450 to overcome the friction fitting and separate lid 1420 from base of quadrant serving section 1405.

FIG. 14B illustrates clasp 1445, which, as illustrated, may traverse a span of an arc perimeter of quadrant serving section 1405.

Figure 15B:
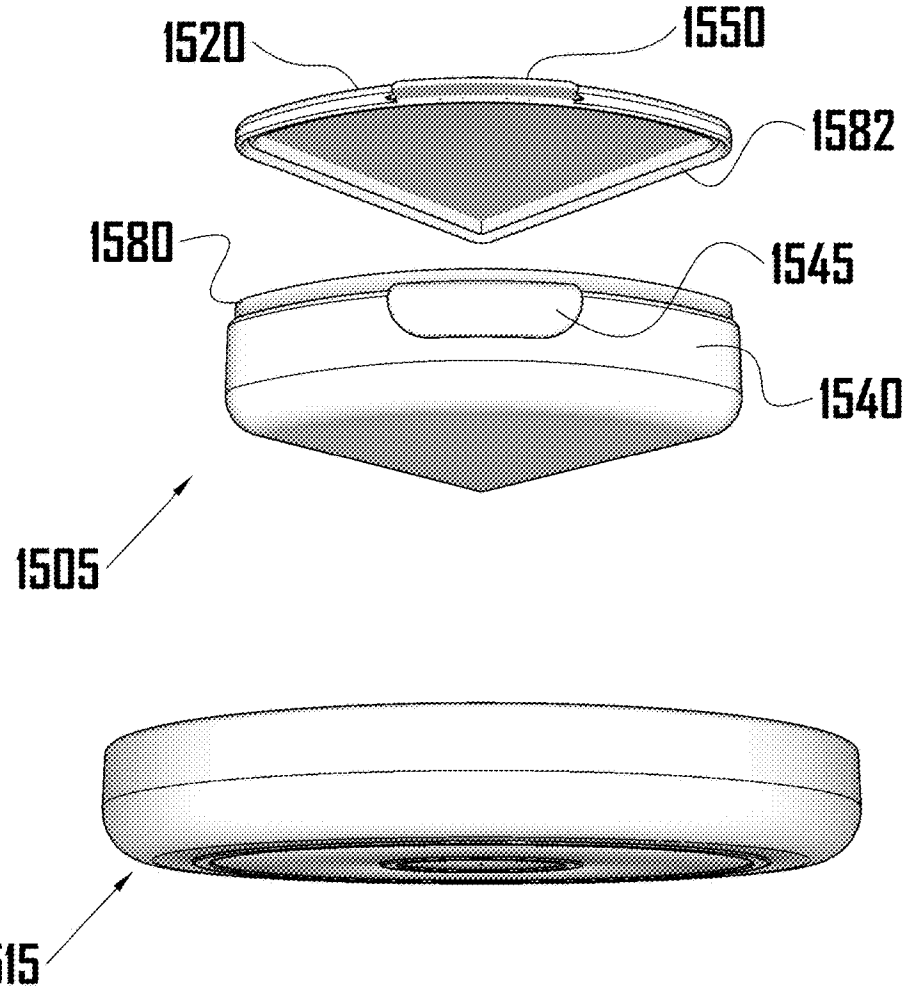
FIG. 15B is a back isomorphic perspective projection of the exploded plate and quadrant serving section of FIG. 14A, according to some embodiments.
Figure 15A:
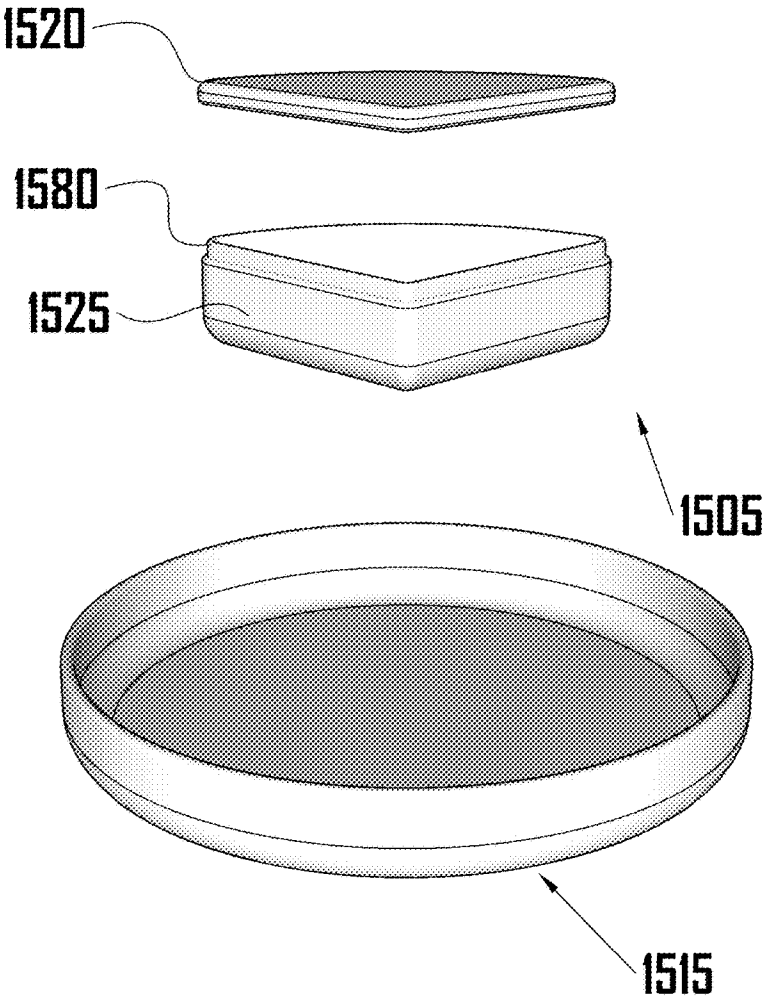
FIG. 15A is a front isomorphic perspective projection of an exploded plate and quadrant serving section, incorporated with teachings of the present disclosure illustrating an embodiment of a lid, according to some embodiments.

FIG. 15A is a front isomorphic perspective projection of an exploded plate 1515 and quadrant serving section 1505, incorporated with teachings of the present disclosure and illustrating an alternative embodiment of a lid and a friction fitting, according to some embodiments.

FIG. 15B is a back isomorphic perspective projection of the exploded plate 1515 and quadrant serving section 1505 of FIG. 15A, incorporated with teachings of the present disclosure and illustrating an alternative embodiment comprising a lid 1520 and a friction fitting, according to some embodiments.

FIG. 15A illustrates an example of serving section flange 1580 and lid-channel 1582, into which serving section flange 1580 fits, forming a friction fitting. When lid 1520 and lid-channel 1582 are fitted to serving section flange 1580, a force vector may be applied to lid flange 1550 to overcome the friction fitting and separate lid 1520 from base of quadrant serving section 1505.

FIG. 15B illustrates clasp 1545, which, as illustrated, may traverse a portion of a span of an arc perimeter of quadrant serving section 1505. Clasp 1545 may also extend downward further than, for example, clasp 1445 illustrated in FIG. 14B, though it may not extend downward as for as, for example, clasp 145 illustrated in, for example, FIGS. 11A and 11B.

Certain elements discussed in relation to other of the figures are similar to similarly named elements in other embodiments, such as vertical radius wall 1525, vertical arc wall 1540, and plate 1515.

The invention claimed is:

1. A serving dish apparatus comprising a plate and a plurality of serving sections, wherein:

the plurality of serving sections are releasably attachable to and from the plate by a human without the use of tools via a friction fitting in each of the plurality of serving sections;

wherein the plate comprises:

a flat horizontal interior plate base, a flat horizontal exterior plate base, an interior plate hip, an exterior plate hip, wherein the interior plate hip has an interior plate hip cross section with an interior plate hip profile of a first quarter of a first circular arc centered on a point above the exterior plate base an wherein the exterior plate hip has an exterior plate hip cross section with an exterior plate hip profile of a second quarter of a second circular arc centered on the point above the exterior plate base, an interior curved vertical wall, and an exterior curved vertical wall;

wherein each of the plurality of serving sections comprises a nose, a serving section base, two vertical radius walls, an arc hip, a vertical arc wall, and a clasp formed of a material continuous with the vertical arc wall, wherein the clasp and the vertical arc wall form a clasp negative space, wherein the clasp negative space is sized to accommodate within it the interior curved vertical wall of the plate and the exterior curved vertical wall of the plate and to thereby form the friction fitting;

wherein each of the plurality of serving sections occupies a sector of the plate;

wherein the nose of each of the plurality of serving sections comprises a round nose radius, wherein a point of the round nose radius follows a nose path around a center of the plate, wherein exteriors of the two vertical radius walls of the plurality of serving sections are centered on the center of the plate, wherein thereby a first nose of a first of the plurality of serving sections and a second nose of a second of the plurality of serving sections do not overlap in any positions occupied by the serving sections in the plate; and wherein the first of the plurality of serving sections occupies a first sector of the plate and the second of the plurality of serving sections occupies a second sector of the plate, wherein the first sector of the plate is larger than the second sector of the plate, and wherein a first nose path of the first nose of the plurality of serving sections is closer tot the center of the plate than a second nose path of the second nose of the plurality of serving sections.

2. The serving dish apparatus according to claim 1, wherein the friction fitting comprises a friction pad in the serving section.

3. The serving dish apparatus according to claim 2, wherein the friction pad is a rubbery material.

* * * * *